US008347673B2

(12) United States Patent
Wang et al.

(10) Patent No.: US 8,347,673 B2
(45) Date of Patent: Jan. 8, 2013

(54) CODE LOCK

(76) Inventors: Sung-Ming Wang, Yung Kang (TW); Mei-Li Wang, Tainan (TW)

( * ) Notice: Subject to any disclaimer, the term of this patent is extended or adjusted under 35 U.S.C. 154(b) by 575 days.

(21) Appl. No.: 12/591,281

(22) Filed: Nov. 16, 2009

(65) Prior Publication Data

US 2011/0113839 A1 May 19, 2011

(51) Int. Cl.
*E05B 13/00* (2006.01)

(52) U.S. Cl. ..... 70/214; 70/288; 70/298; 70/327; 70/DIG. 44

(58) Field of Classification Search ..... 70/213, 70/214, 286, 287, 288, 291, 292, 293, 294, 70/295, 297, 298, 299, 324, 327, 330
See application file for complete search history.

(56) References Cited

U.S. PATENT DOCUMENTS 3,009,346 A * 11/1961 Check ..... 70/150
3,115,028 A * 12/1963 Windle ..... 70/288
4,748,833 A * 6/1988 Nagasawa ..... 70/214
4,936,894 A * 6/1990 Larson et al. ..... 70/298
6,145,355 A * 11/2000 Burleigh et al. ..... 70/298
6,298,698 B1 * 10/2001 Nakajima et al. ..... 70/214
6,334,346 B1 * 1/2002 Wang ..... 70/214
7,043,948 B1 * 5/2006 Wang ..... 70/214
7,318,331 B2 * 1/2008 Miao ..... 70/214
2005/0210937 A1 * 9/2005 Okuda ..... 70/214
2011/0016935 A1 * 1/2011 Wang ..... 70/288

* cited by examiner

*Primary Examiner* — Christopher Boswell
(74) *Attorney, Agent, or Firm* — Rosenberg, Klein & Lee

(57) ABSTRACT

A code lock is revealed. The code lock includes a housing, a return base, a plurality of locking seats, a fixed seat, a moveable seat, a code seat, a plurality of code members and a housing base arranged sequentially from top to bottom. A press button corresponding to each locking seat is disposed on the housing and each locking seat has at least one tooth that locks with a hook of the return base when the press button is pressed to push the locking seat. A stopping block is arranged at the bottom of each locking seat while the code member is set with a code post correspondingly. Moreover, the moveable seat includes a code area and a non-code area for mounting the code member and the code seat has a plurality of C-shaped holes corresponding to the code members. Thereby a simple-structured and easy-operated code lock is formed.

13 Claims, 22 Drawing Sheets

CODE LOCK

BACKGROUND OF THE INVENTION

1. Fields of the Invention

The present invention relates to a code lock, especially to a code lock that can be set code by users themselves and with features of easy operation and simple structure.

2. Descriptions of Related Art

The applications of locks are quite accessible today. For example, channel gates, doors, personal closets, safe deposit boxes, vehicles and so on, are arranged with locks so as to manage the opening and closing of the objects by specific staffs or owners. According to different applications, the locks are divided into various types such as key locks, code locks, etc. The key locks are opened and closed by keys, the code locks are opened and closed by input code, and so forth.

The so-called code lock can be set a new code each time the user uses it and the code can be changed as often as required. Thus it's difficult for burglars to break the code and the code locks are quite popular.

There is still a space for improvement of the code lock. Thus a code lock with features of simple structure and easy operation is provided.

SUMMARY OF THE INVENTION

Therefore it is a primary object of the present invention to provide a code lock in which the code can be changed at will and the code setting operation is simple and easy. Moreover, the cost can be reduced due to the simple and compact structure of the code lock.

In order to achieve above object, a code lock of the present invention consists of an housing, a return base, a plurality of locking seats, a fixed seat, a moveable seat, a code seat, a housing base, and a plurality of code members. From bottom to top, the locking seats and the return base are disposed over the fixed seat while the moveable seat, code members, code seat and the housing base are arranged under the fixed seat in sequence. The housing base is covered and fixed by the housing to form the code lock. Furthermore, a press button corresponding to each locking seat is disposed on the housing and each locking seat has at least one tooth that locks with a hook of the return base when the press button is pressed to push the locking seat. A protrudent stopping block is disposed on the bottom of the locking seat while the code member is arranged with a code post correspondingly. The moveable seat includes a long slot that is formed by a code area and a non-code area for mounting the code member. Moreover, the code seat has a plurality of C-shaped holes corresponding to the code members and changing the position of the stopping block of the locking seat while the locking seat being pushed by the press button. The housing is further disposed with a reset button and a knob. Thereby the user can set the code by choose the positions of the code members in the code area or the non-code area of the long slot of the moveable seat. When each press button is not pressed yet, only the code post of each code member in the non-code area is staggered with the stopping block of the locking seat while the code post of each code member in the code area is corresponding to the stopping block of the locking seat. Thus when the input code of the pressed button is correct, the locking seat is moved along with the pressed press button so that the stopping block of the locking seat is no more corresponding to the code post of the code member, becoming in a staggered position and the moveable seat moves along the Y-axis. Therefore, the knob can be rotated to open the code lock. When the code input is wrong, the stopping block of the locking seating corresponding to the input wrong code member is corresponding to the code post of the code member so that the moveable seat mounted with the code member is unable to move. The knob is unable to be rotated to release the lock. If the user wants to reset the lock to release the input wrong code, only the reset button is pressed to drive the hook of the return base releasing from the tooth of the locking seat. Thus the locking seat goes back to the original position and the code lock is ready to be input a new code again.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
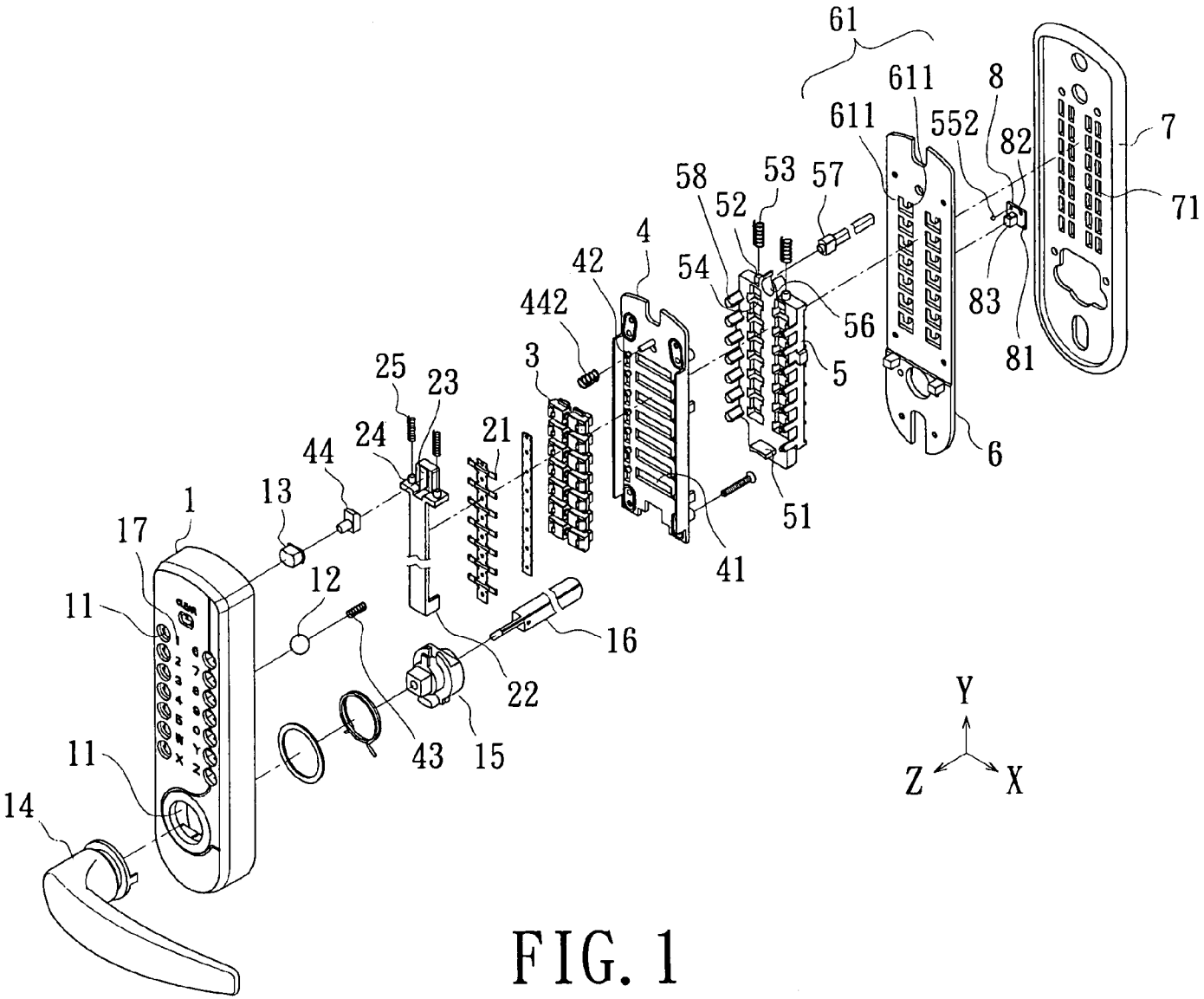
FIG. 1 is an explosive view of an embodiment of a code lock according to the present invention.
Figure 2:
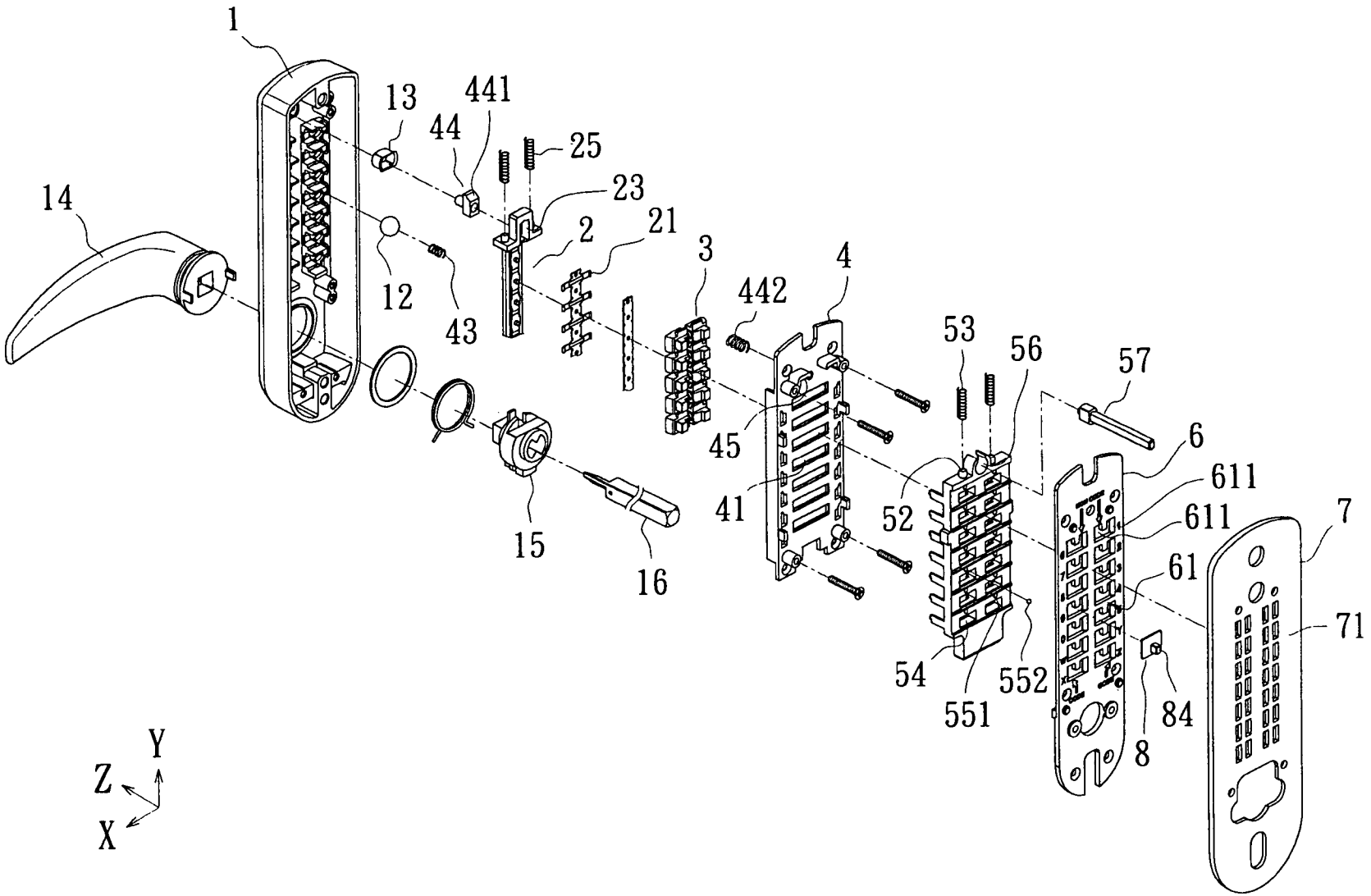
FIG. 2 is a another explosive view of an embodiment of a code lock according to the present invention.

Refer from FIG. 1 to FIG. 8, a code lock of the present invention includes an housing 1, a return base 2, a plurality of locking seats 3, a fixed seat 4, a moveable seat 5, a code seat 6, a housing base 7, and a plurality of code members 8.

The housing 1 is covered and fixed on the housing base 7 correspondingly and having a plurality of assembly holes 11 for mounting a plurality of press buttons 12, a reset button 13 and a knob 14. In this embodiment, the press button 12 is a round bead and is elastically pressed against by a third elastic member 43 of the fixed seat 4. Each press button 12 attaches and contacts with an oblique surface 31 of the locking seat 3. The reset button 13 is also elastically pressed against by an elastic part 44 of the fixed seat 4 while the knob 14 moves together with an interlock rod 16 through a push member 15 and the interlock rod 16 drives a latch (not shown in figure) set in a door to extend or retract. Moreover, a specific symbol 17 is labeled beside each assembly hole 11.

The return base 2 disposed over each locking seat 3 consists of a plurality of hooks 21 on a bottom side thereof, a leaning part 22 extending downward from one end, a receiving slot 23 arranged at the other end for mounting the elastic part 44 of the fixed seat 4, a positioning rod 24 projecting from each side of the receiving slot 23, and at least one first elastic member 25. Each hook 21 corresponds to a tooth 32 of the locking seat 3. The outer surface of the leaning part 22 is attached by a pressing part 51 of the moveable seat 5. The receiving slot 23 and the elastic part 44 respectively include a slanting surface 231, 441, corresponding to each other. One end of the first elastic member 25 is sleeved with the positioning rod 24 while the other end thereof leans against an inner surface of the housing 1.

Figure 3:
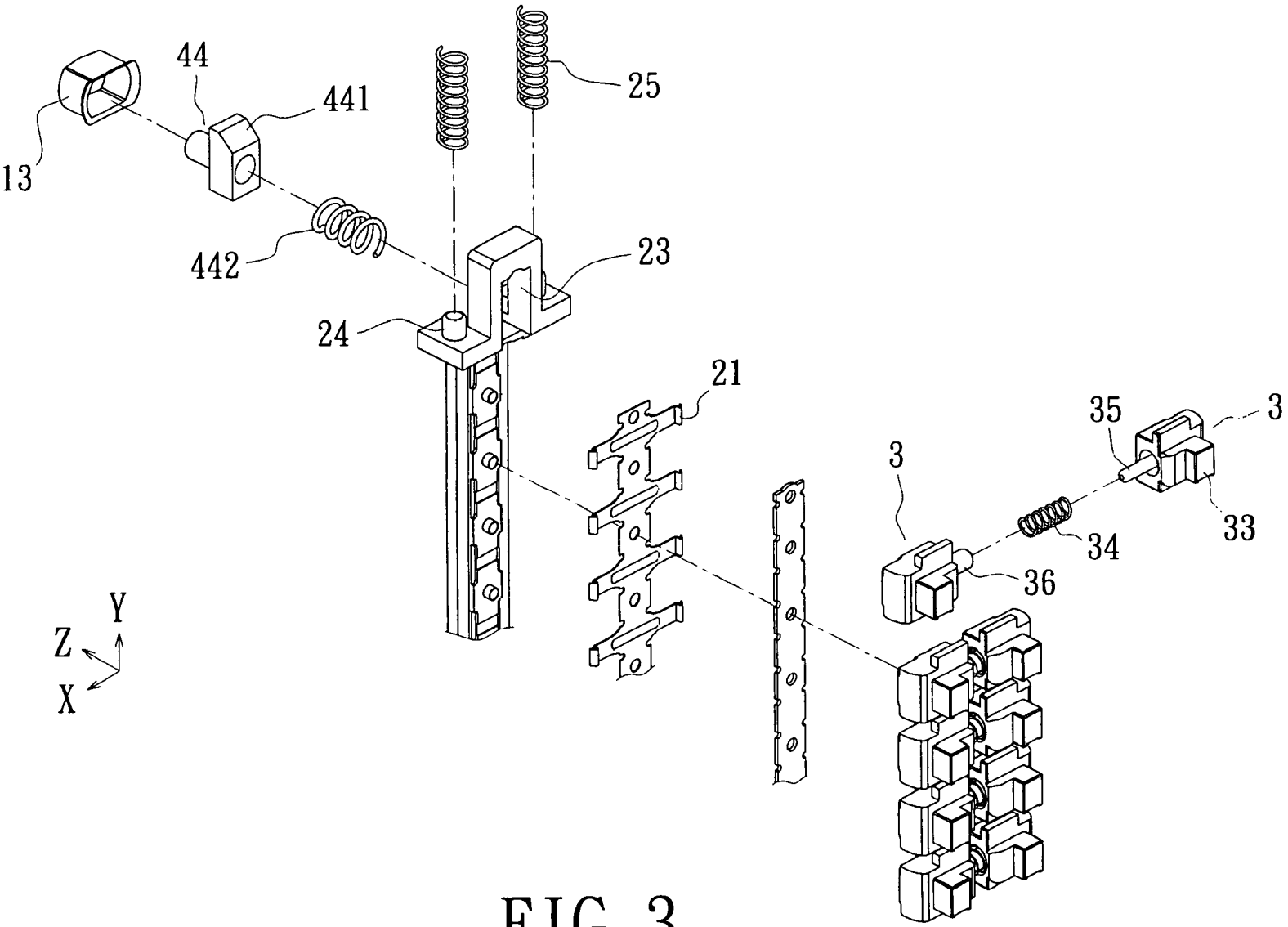
FIG. 3 is a partial enlarged view of an embodiment of a code lock according to the present invention.
Figure 4:
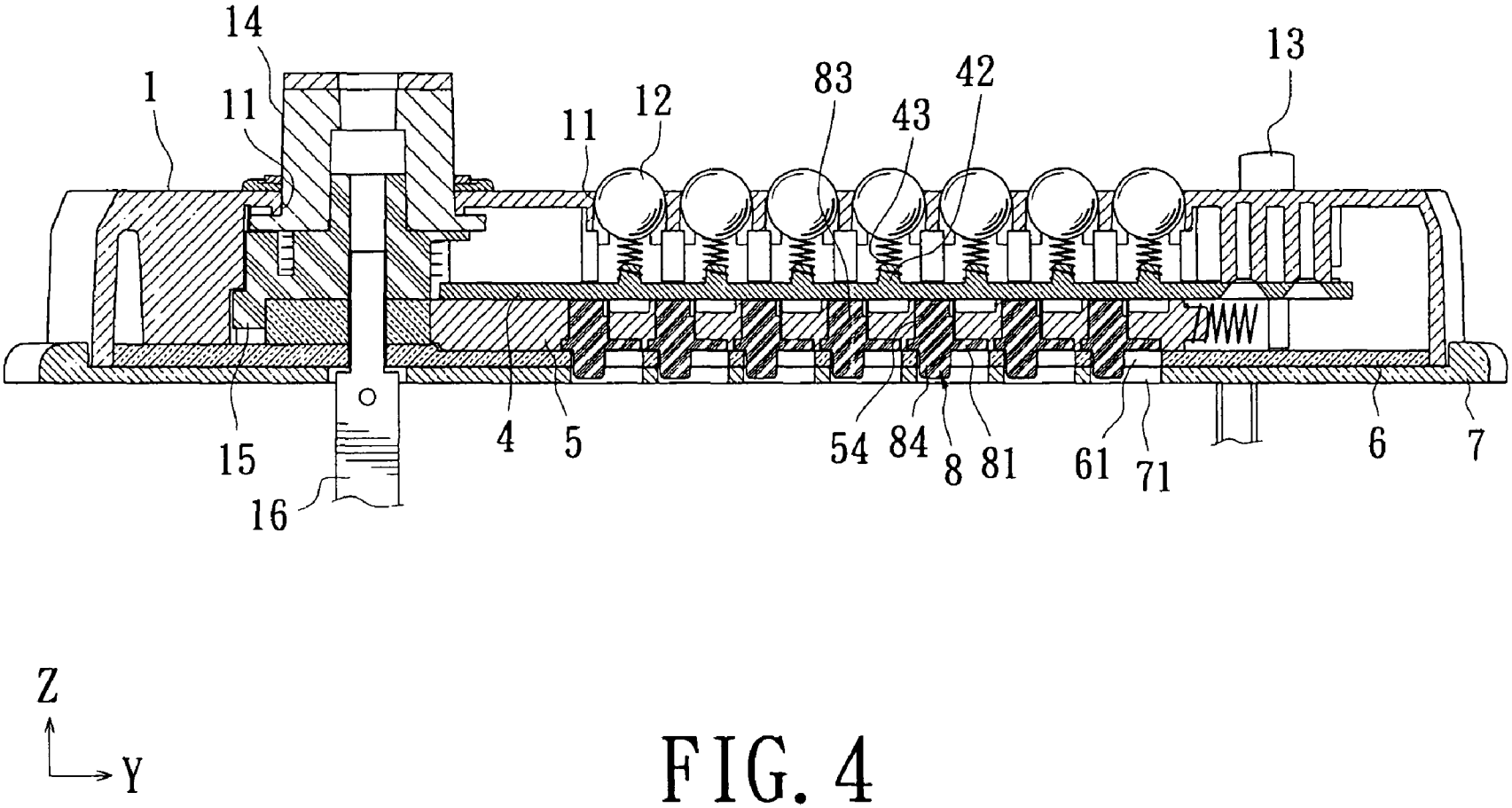
FIG. 4 is a cross sectional view of an embodiment of a code lock along the Y-Z plane according to the present invention.
Figure 5:
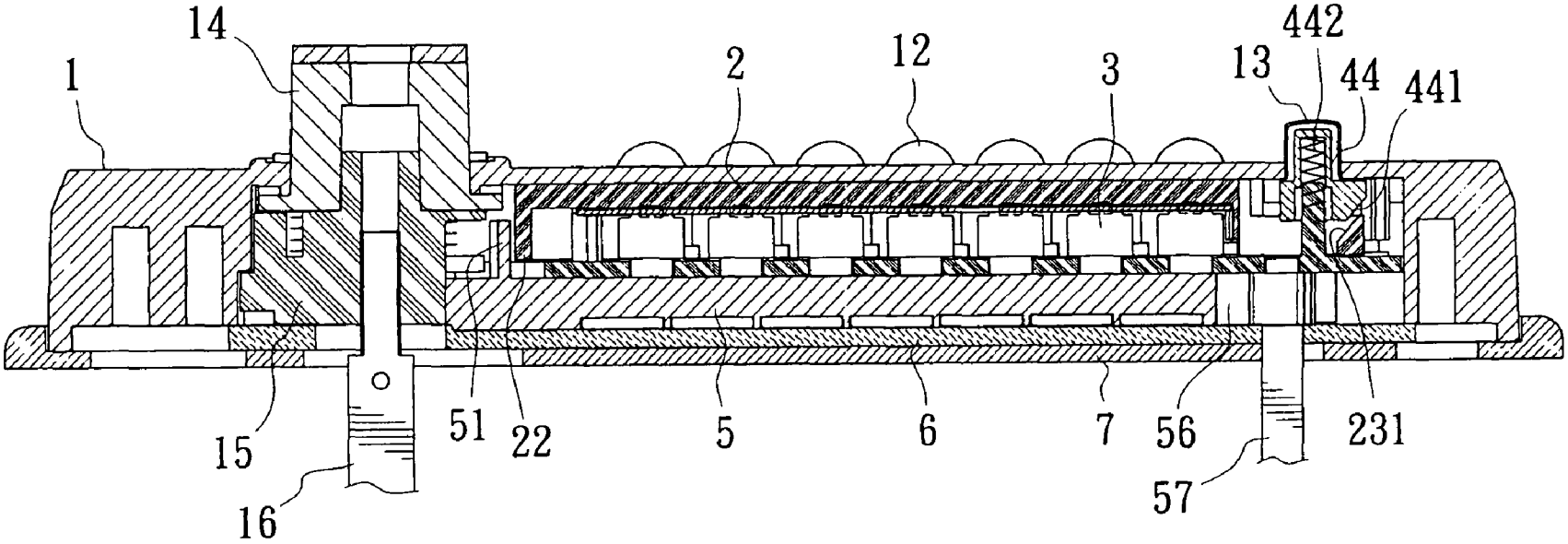
FIG. 5 is another cross sectional view of an embodiment of a code lock along the Y-Z plane according to the present invention.
Figure 6:
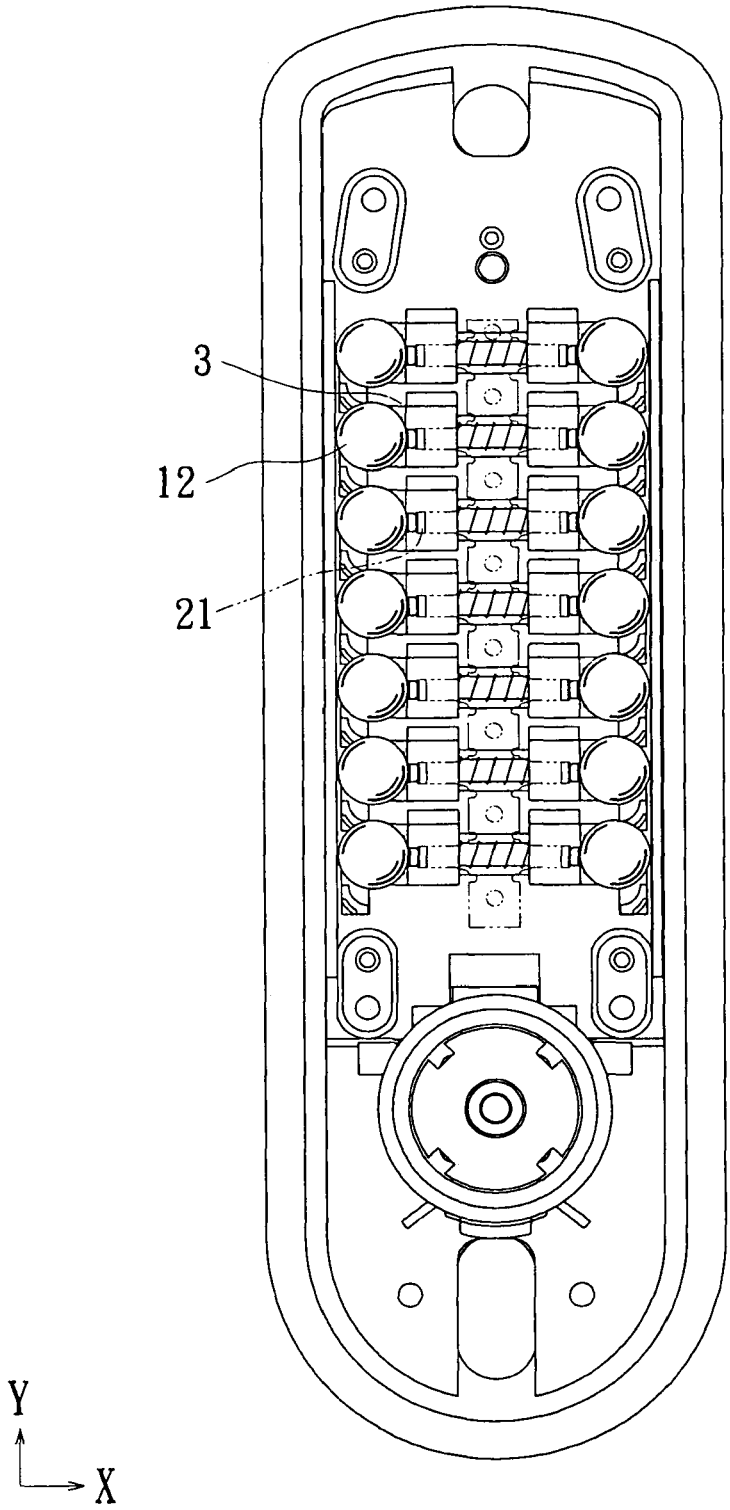
FIG. 6 is a schematic drawing showing relationship among press buttons, hooks, teeth and locking seats along the X-Y plane according to the present invention.
Figure 7:
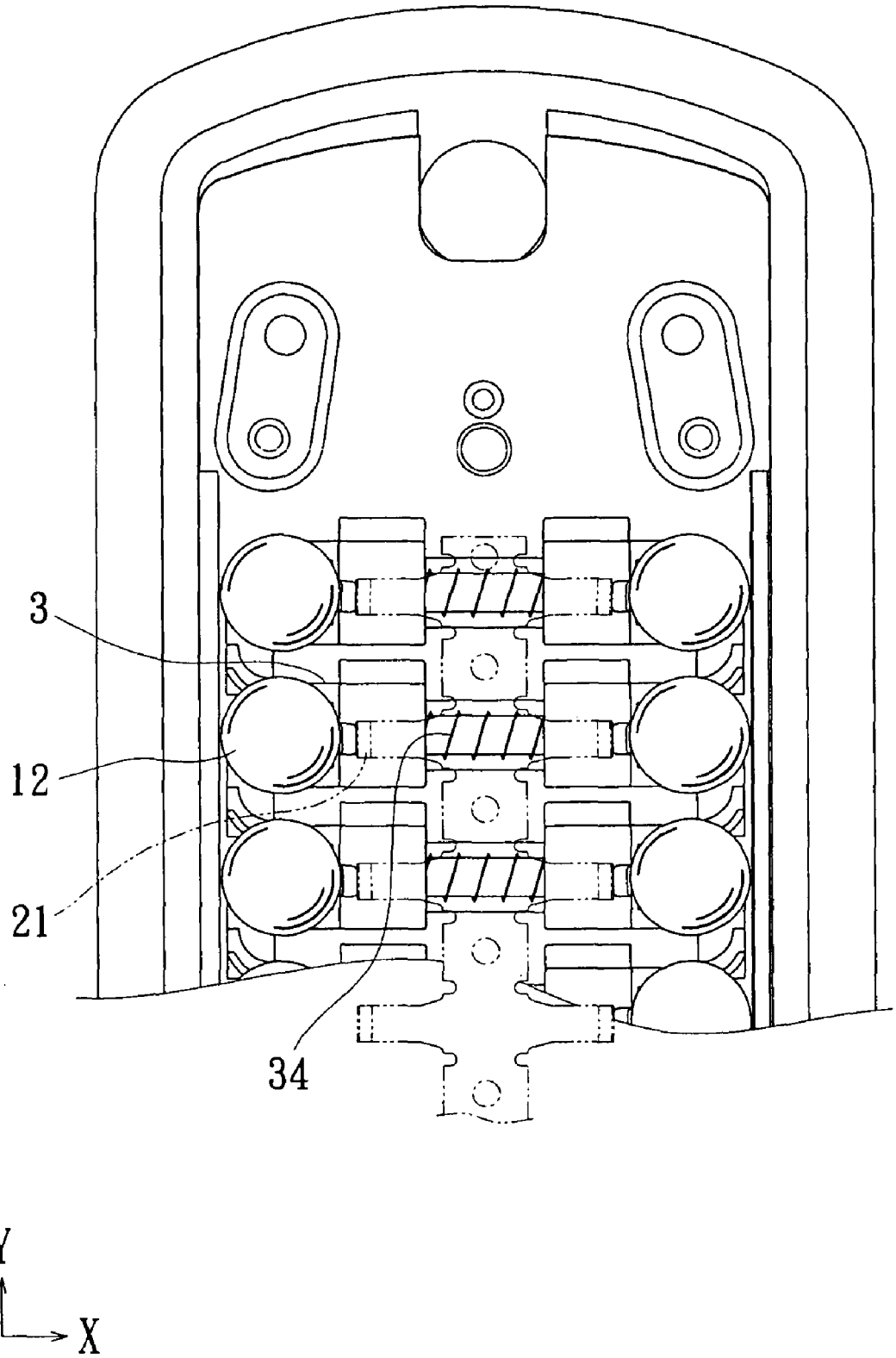
FIG. 7 is a partial enlarged view of the embodiment in FIG. 6.
Figure 10:
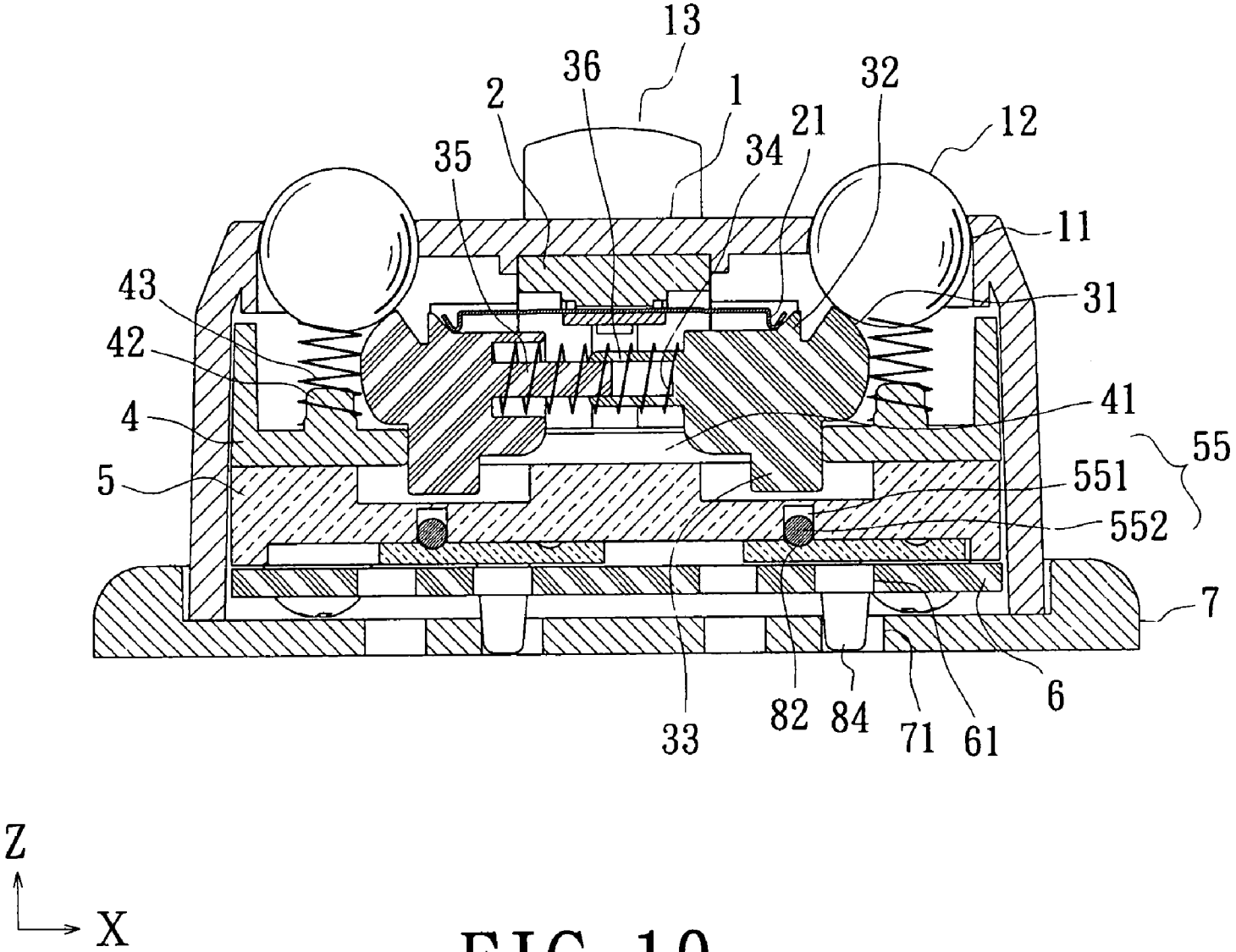
FIG. 10 is a cross sectional view along the X-Z plane after setting the code according to the present invention.
Figure 11:
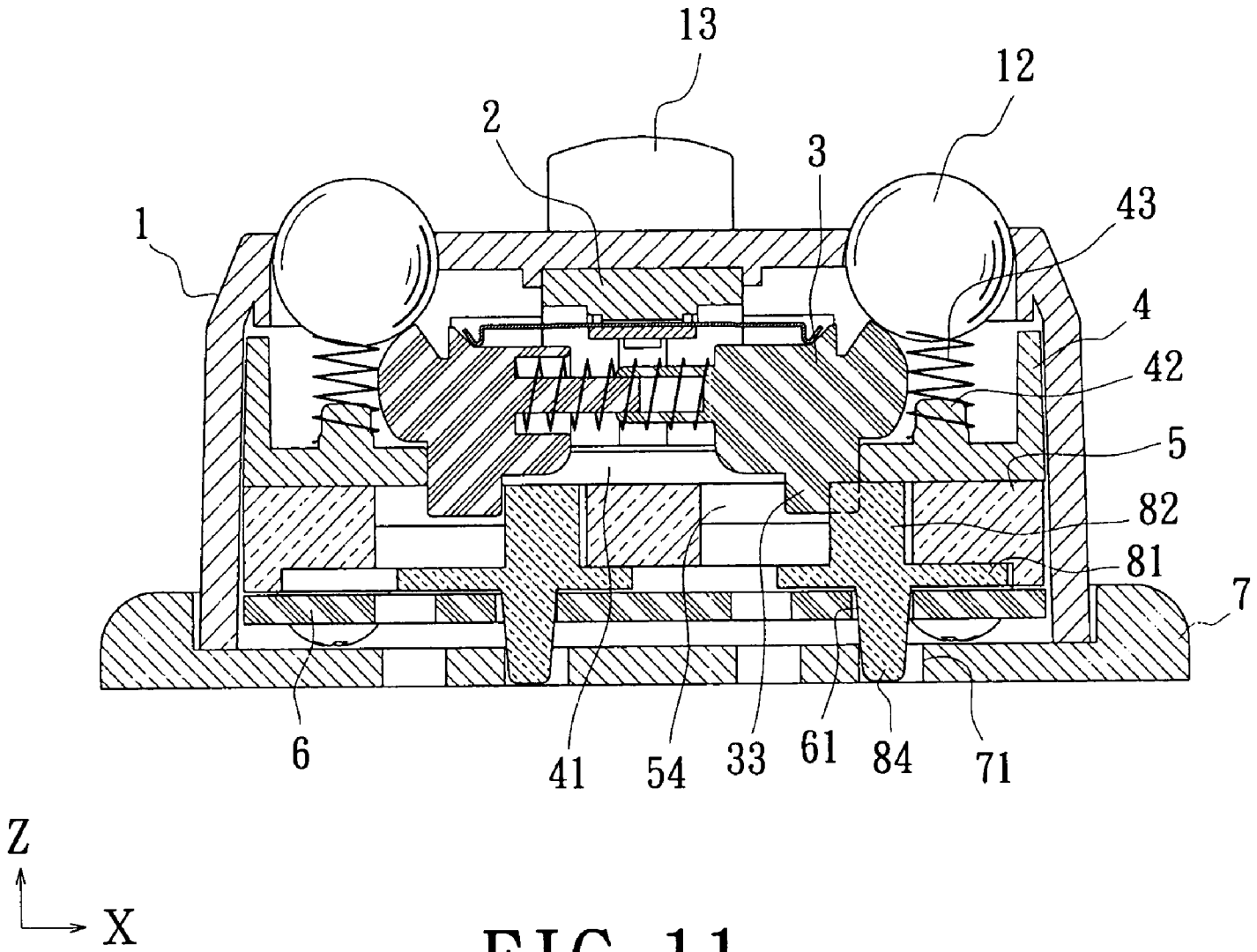
FIG. 11 is another cross sectional view along the X-Z plane after setting the code according to the present invention.
Figure 12:
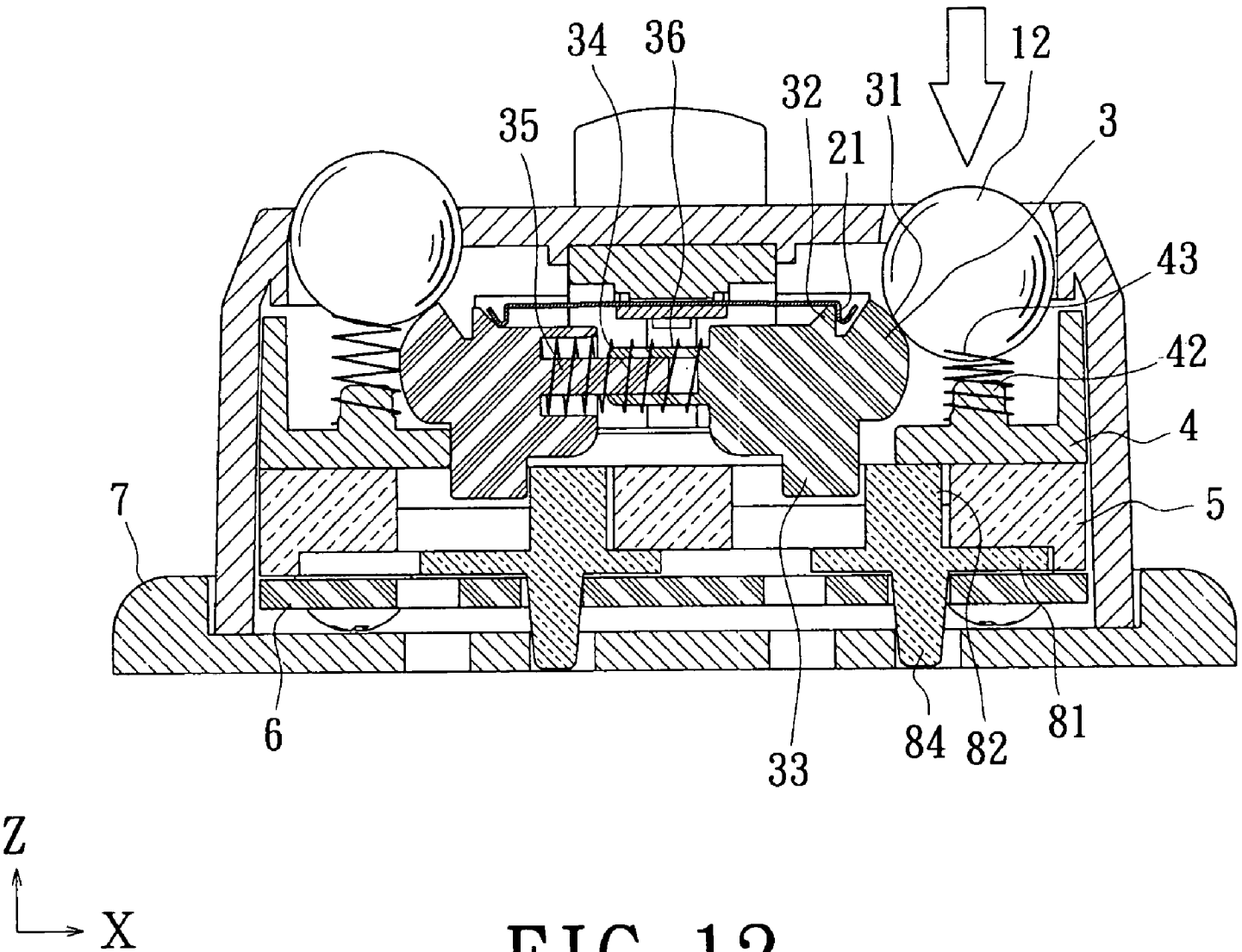
FIG. 12 is a cross sectional view along the X-Z plane after the press button being pressed according to the present invention.
Figure 13:
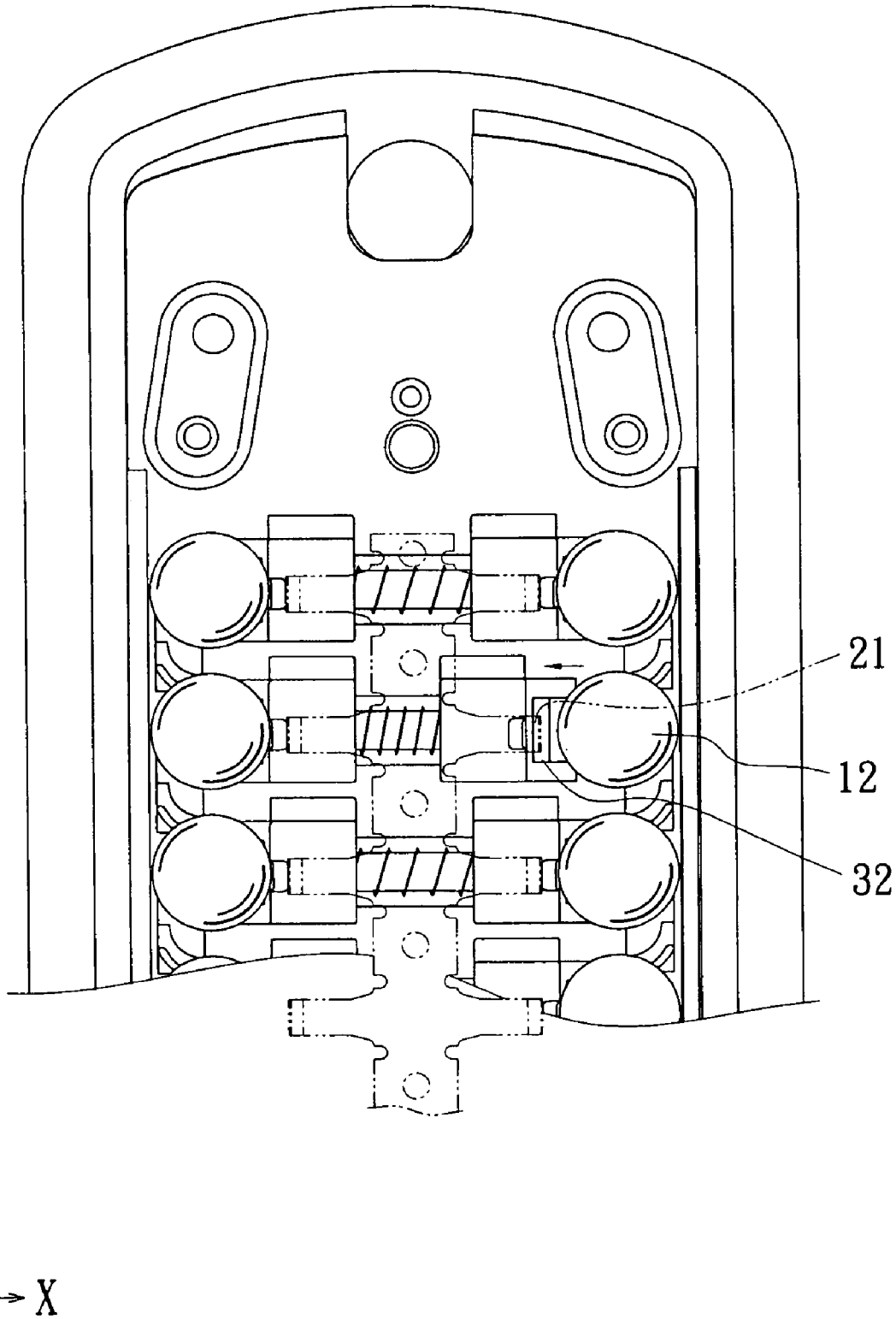
FIG. 13 is a rear cross sectional view along the X-Y plane after the press button with the specific symbol of "7" being pressed according to the present invention.
Figure 14:
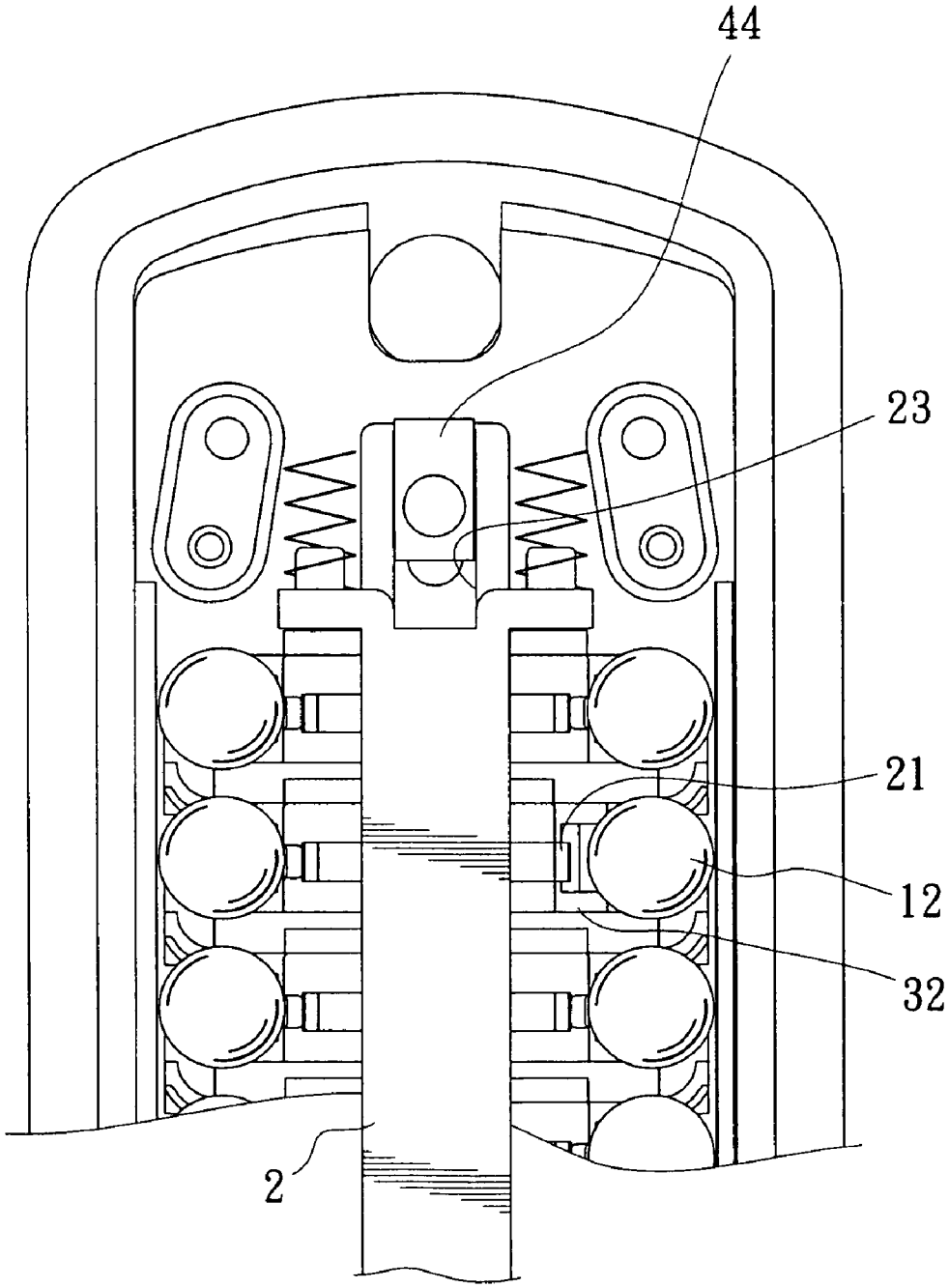
FIG. 14 is another rear cross sectional view along the X-Y plane after the press button with the specific symbol of "7" being pressed according to the present invention.
Figure 14:
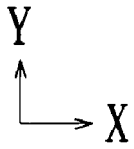
Figure 15:
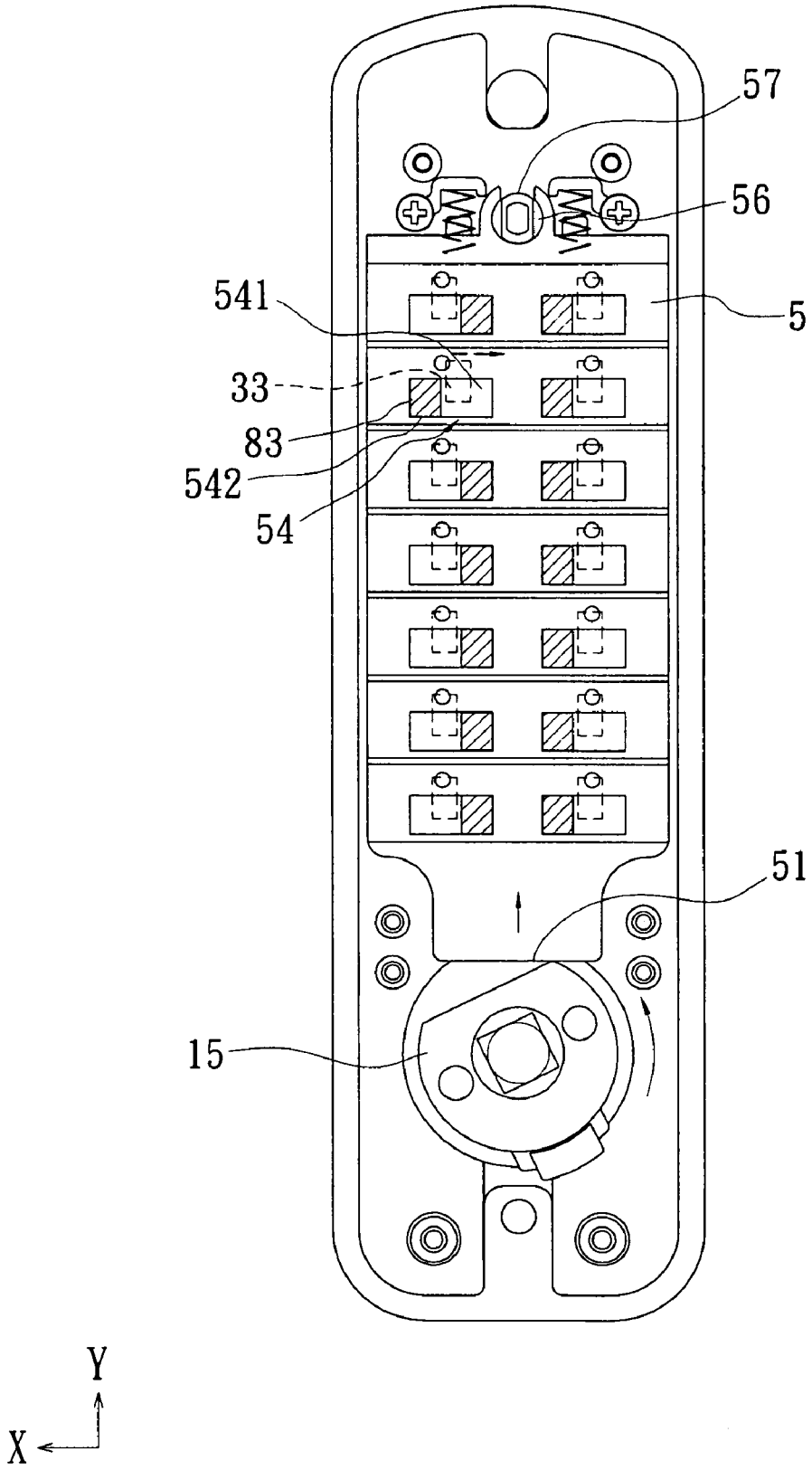
FIG. 15 is a front cross sectional view along the X-Y plane after the press button with the specific symbol of "7" being pressed and the knob being rotated according to the present invention.
Figure 16:
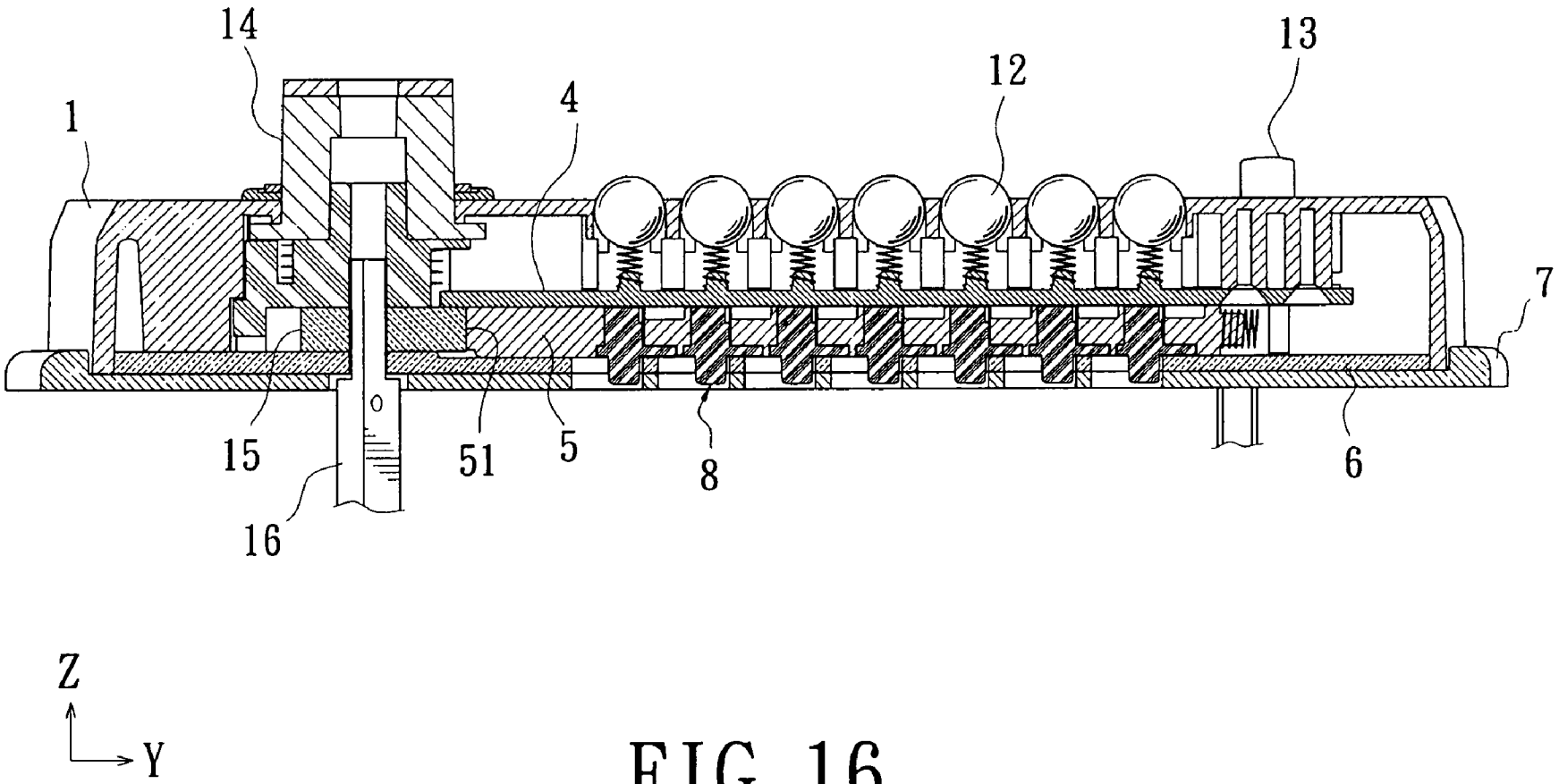
FIG. 16 is a cross sectional view along the X-Z plane after the press button with the specific symbol of "7" being pressed and the knob being rotated according to the present invention.

Refer to FIG. 3 and FIG. 10, the locking seat 3 is arranged over the fixed seat 4. The oblique surface 31 and the tooth 32 are set on a top surface of the locking seat 3 and a stopping block 33 is disposed on a bottom thereof. The locking seats 3 are set in a pair with a second elastic member 34 therebetween. The end surfaces of a pair of locking seat 3 that face the each other respectively are disposed with a rod 35 and a sleeve 36 projectingly. The rod 35 inserts into the sleeve 36 so as to fix and set the second elastic member 34 around the rod 35 as well as the sleeve 36.

The fixed seat 4 includes a plurality of parallel long through holes 41 that penetrates the bottom surface thereof to be inserted through by the stopping block 33 of the locking seat 3, a projecting rod 42 sleeved with the third elastic member 43 around arranged projectingly upward at the side of the long through hole 41, an elastic part 44 with a slanting surface 441 and a positioning part 45 on the other side of the other end thereof. The elastic part 44 is corresponding to the reset button 13 and a fourth elastic member 442 is arranged between the elastic part 44 and the fixed seat 4 so as to make the elastic part 44 have elasticity.

Figure 9:
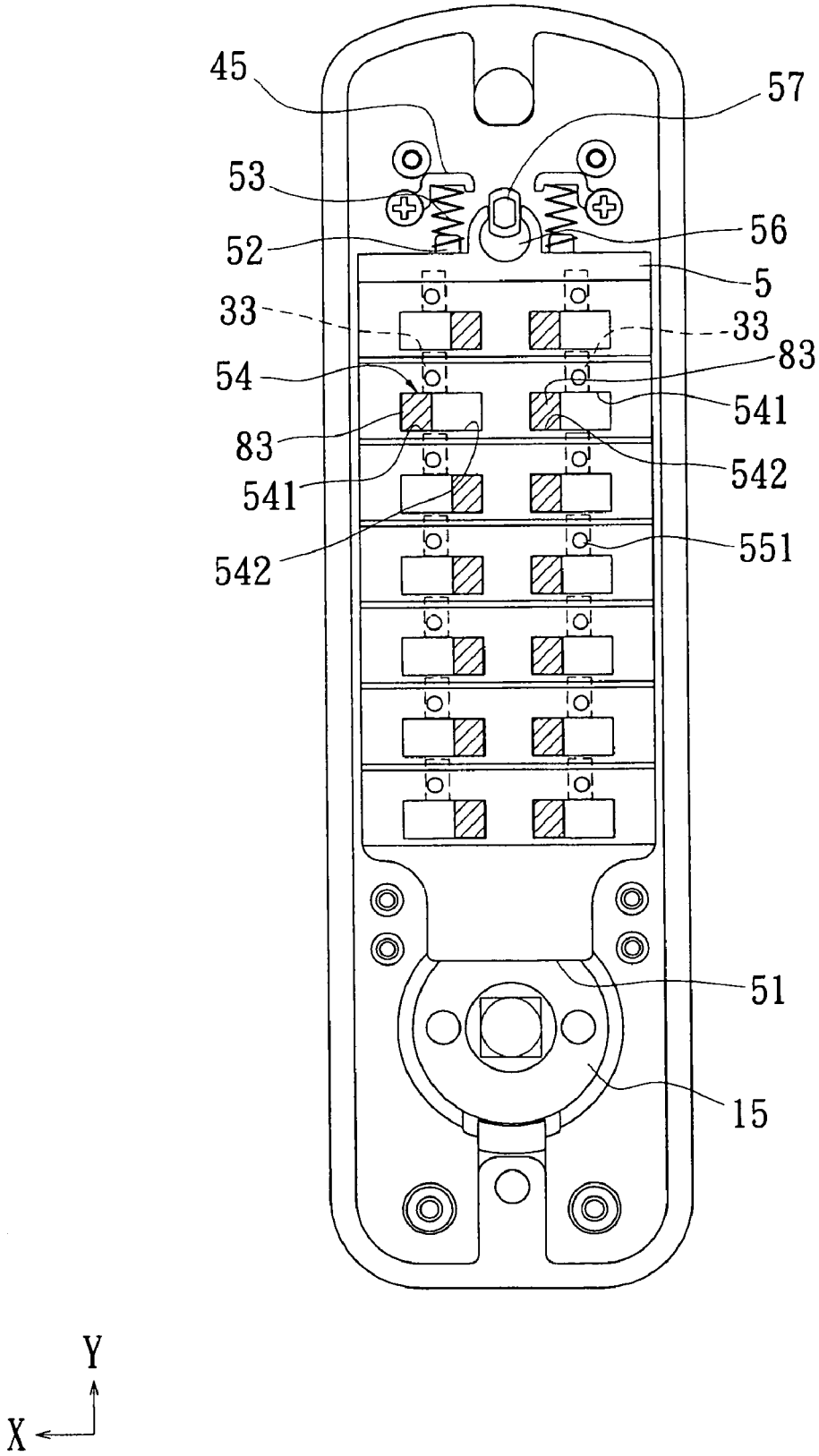
FIG. 9 is a front cross sectional view along the X-Y plane of an embodiment in which the code is set to "7" according to the present invention.

The moveable seat 5 includes a pressing part 51 on one end so as to attach and contact with the leaning part 22 of the return base 2 while this end also contacts with the push member 15 of the housing 1. A positioning part 52 is disposed on the other end of the moveable seat 5 so as to sleeve with one end of a fifth elastic member 53 and the other end of the fifth elastic member 53 is positioned at the positioning part 45 of the fixed seat 4. Moreover, a plurality of long slots 54 is arranged at the moveable seat 5. Each long slot 54 consists of a code area 541 and a non-code area 542, as shown in FIG. 9. The long slot 54 is corresponding to the long through hole 41 of the fixed seat 4 and the locking seat 3 and each long slot 54 is arranged with a positioning member 55 formed by a positioning hole 551 and a round bead 552 mounted in the positioning hole 551.

The code seat 6, arranged under the moveable seat 5 and fixed with the fixed seat 4, includes a plurality of C-shaped holes 61 corresponding to the long through holes 41 of the fixed seat 4 and the locking seats 3. Each of the two sides of the C-shaped holes 61 is with a vertical projecting parts 611 that is connected with each other at one end.

The housing base 7 is covered by and fixed with the housing 1. The housing 7 includes a plurality of grooves 71 corresponding to each push rod 84 of each code member 8 and the push rod 84 of the code member 8 is exposed outside the surface of the housing.

The code member 8 is composed of a plate 81, two positioning holes 82 arranged at the plate 81, a code post 83 beside the positioning holes 82, and a push rod 84 on one side of the plate 81 that faces the housing base 7. The positioning holes 82 are for mounting the positioning member 55 of the moveable seat 5 correspondingly so as to provide positioning effect when the code member 8 is pushed. The code post 83 inserts through the vertical projecting part 611 of the C-shaped holes 61 of the code seat 6 to be loaded in the long slot 54 of the moveable seat 5.

Figure 8:
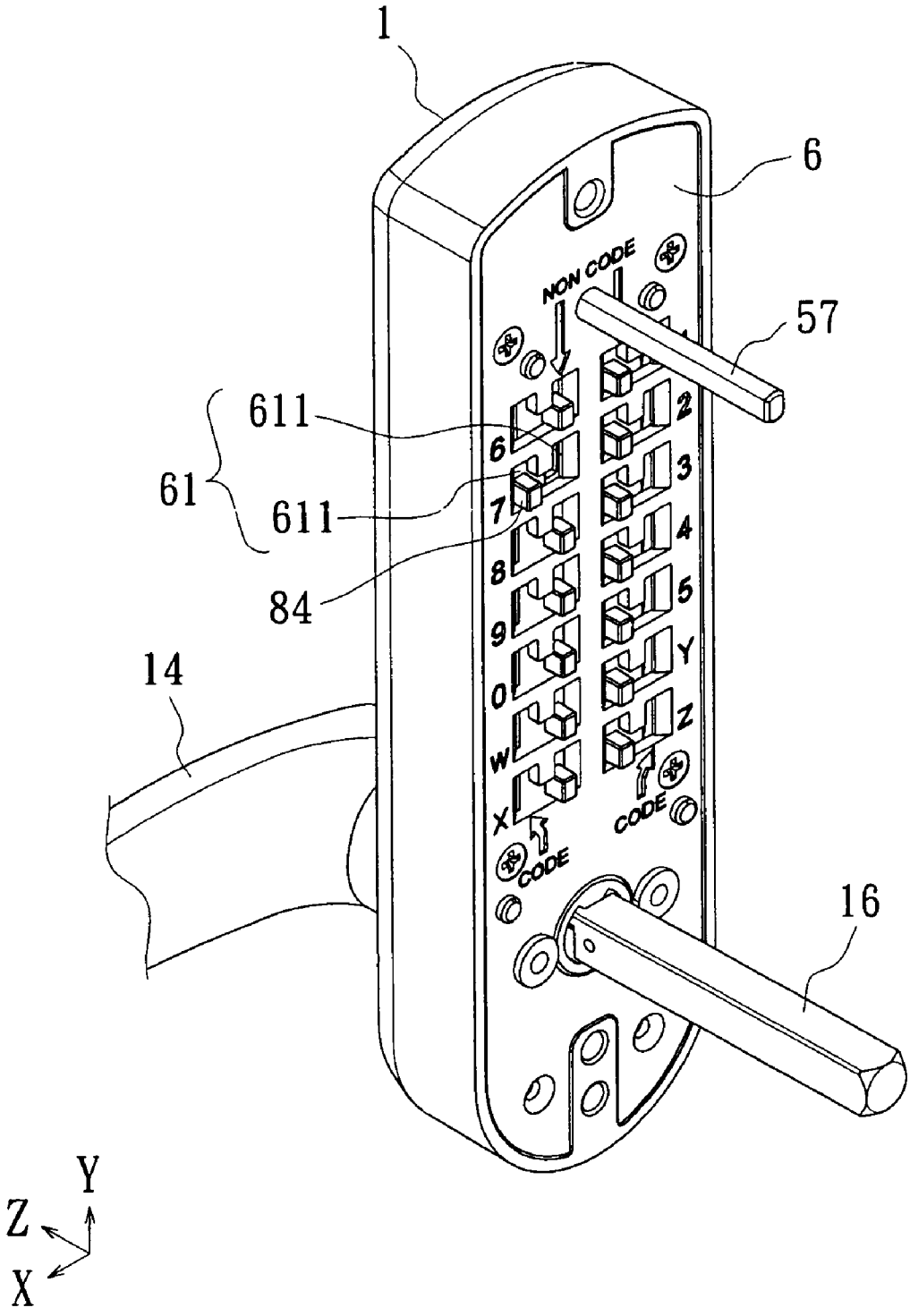
FIG. 8 is a perspective view of an embodiment of a code lock according to the present invention.

When a user intends to set a code, refer to FIG. 1 and FIG. 8 to FIG. 11, the code post 83 of the code member 8 is mounted in a horizontal connection part between the vertical projecting part 611 of the C-shaped holes 61 of the code seat 6. Thus when the code member 8 is moved, the code post 83 only moves horizontally in the horizontal connection part. Moreover, the pushed code member 8 is positioned by the assembly of the positioning hole 82 on the plate 81 of the code member 8 with the positioning member 55 of the moveable seat 5 correspondingly. According to the code intended to be set, the user pushes the push rod 84 of the code member 8 corresponding to the set code to be set by the hand so as to make the code post 83 mount correspondingly in the code area 541 of the long slot 54 of the moveable seat 5. Now the code post 83 of the code member 8 is moved from one of the projecting parts 611 of the C-shaped holes 61 of the code seat 6 to the other projecting part 611 while the push rod 84 of the code member 8 not related to the set code is mounted in the non-code area 542 of the long slot 54 of the moveable seat 5. For example, as shown in FIG. 8, the code is going to be set to "7" and the code post 83 of the code member 8 located on the specific symbol 17 of "7" is pushed to the code area 541 of the long slot 54 of the moveable seat 5 while the code posts 83 of the code members 8 located on the specific symbols 17 of other numbers are moved to the non-code area 542 of the long slot 54 of the moveable seat 5. Now the code post 83 of the code member 8 located on the specific symbol 17 of "7" is corresponding to the stopping block 33 of the locking seat 3 and the code posts 83 of other code members 8 are staggered with respect to the stopping block 33 of the locking seat 3.

When the user wants to release the lock, refer to FIG. 1 and FIG. 12 to FIG. 16, the press button 12 with the specific symbol 17 of "7" is pressed downward and then the corresponding oblique surface 31 of the locking seat 3 is moved to the other side of the locking seat 3 without the oblique surface 31 by the press button 12 so that the tooth 32 of the locking seat 3 passes over the hook 21 of the return base 2 and locks with the hook 21 of the return base 2. Due to such movement, the stopping block 33 of the locking seat 3 that originally is corresponding to the code post 83 of the code member 8 becomes to a staggered position relative to the code post 83. At this time, the code posts 83 of the code members 8 are all staggered with the stopping blocks 33 of the locking seats 3. The code member 8 is not more stopped. Thus the knob 14 drives the push member 15 to push the moveable seat 5 and the moveable seat 5 is moved to make the interlock rod 16 move the latch into a retracted position. The lock is opened. The movement of the moveable seat 5 makes the pressing part 51 push the leaning part 22 of the return base 2 so that the return base 2 moves toward the end thereof connected with the leaning part 22. Such movement enables the tooth 32 of the locking seat 3 corresponding to the specific symbol 17 of "7" and the hook 21 of the return base 2 are released from each other. The locking seat 3 turns back to the original position due to an elastic restoring force of the elastic member 34 while the return base 2 also goes back to the original position due to a restoring force of the elastic member 25. Then wait for next input of the code.

Figure 17:
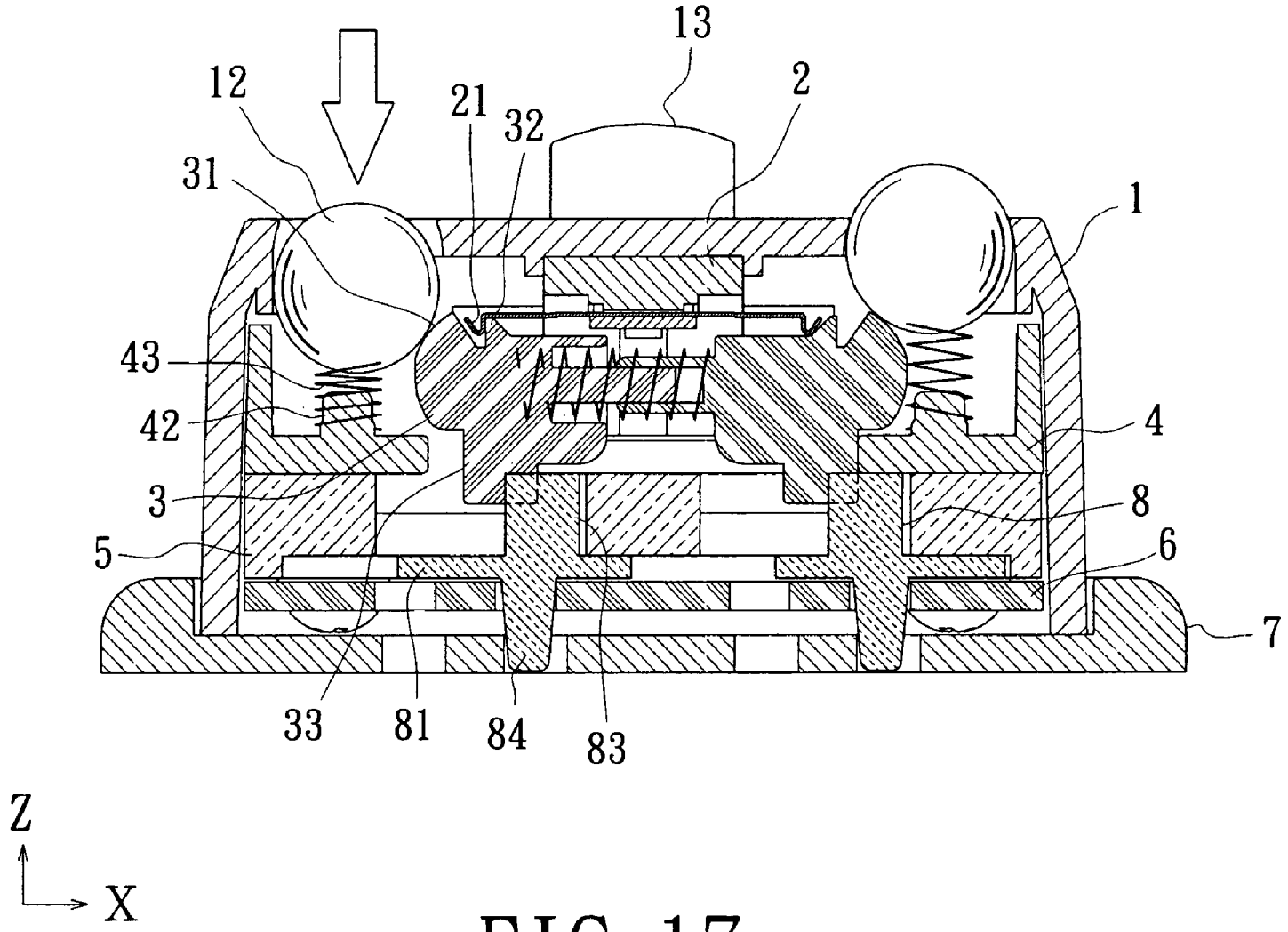
FIG. 17 is a cross sectional view along the X-Z plane when the press button with a wrong code is pressed according to the present invention.
Figure 18:
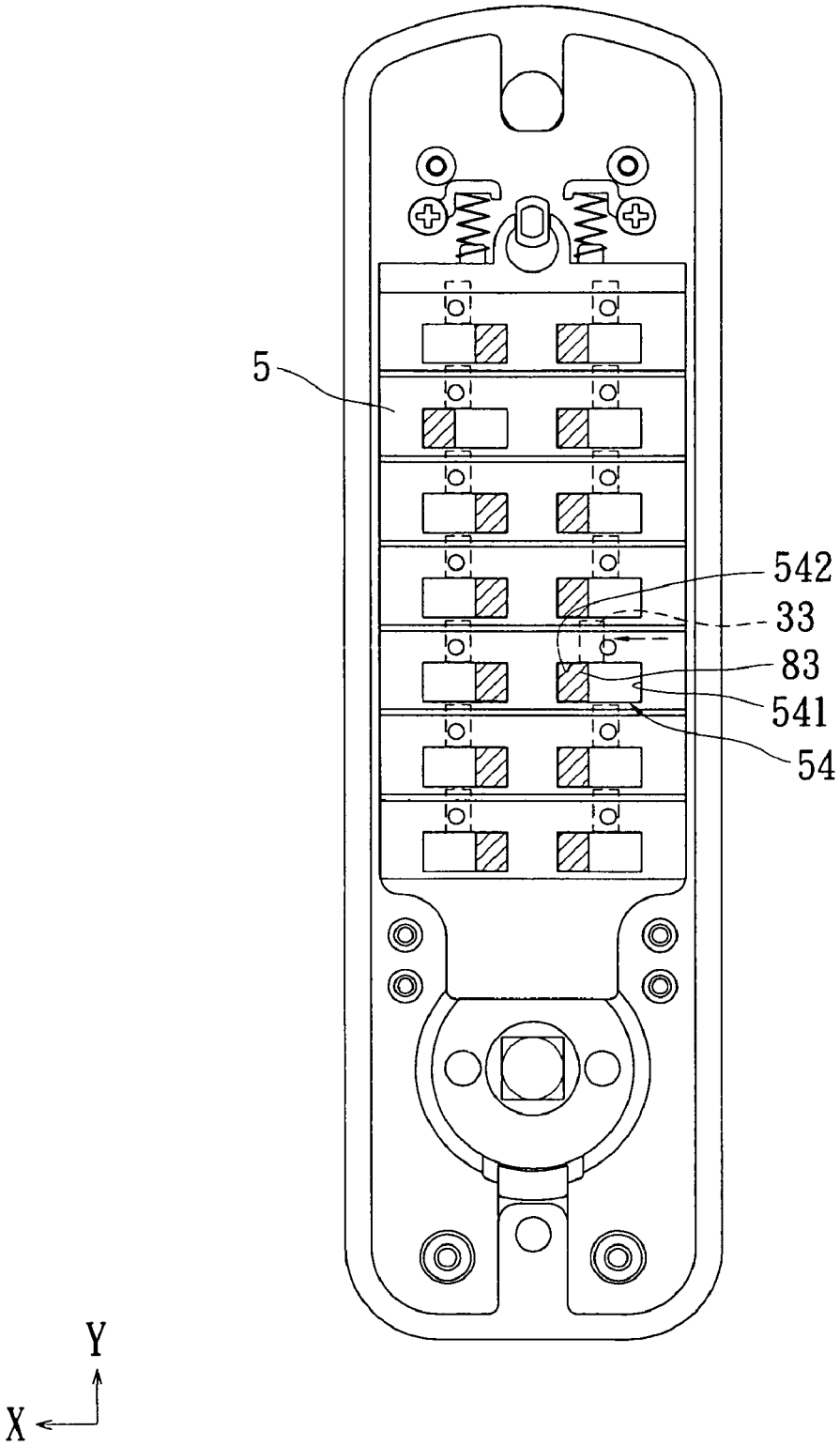
FIG. 18 is a front cross sectional view along the X-Y plane when the press button with a wrong code is pressed according to the present invention.
Figure 19:
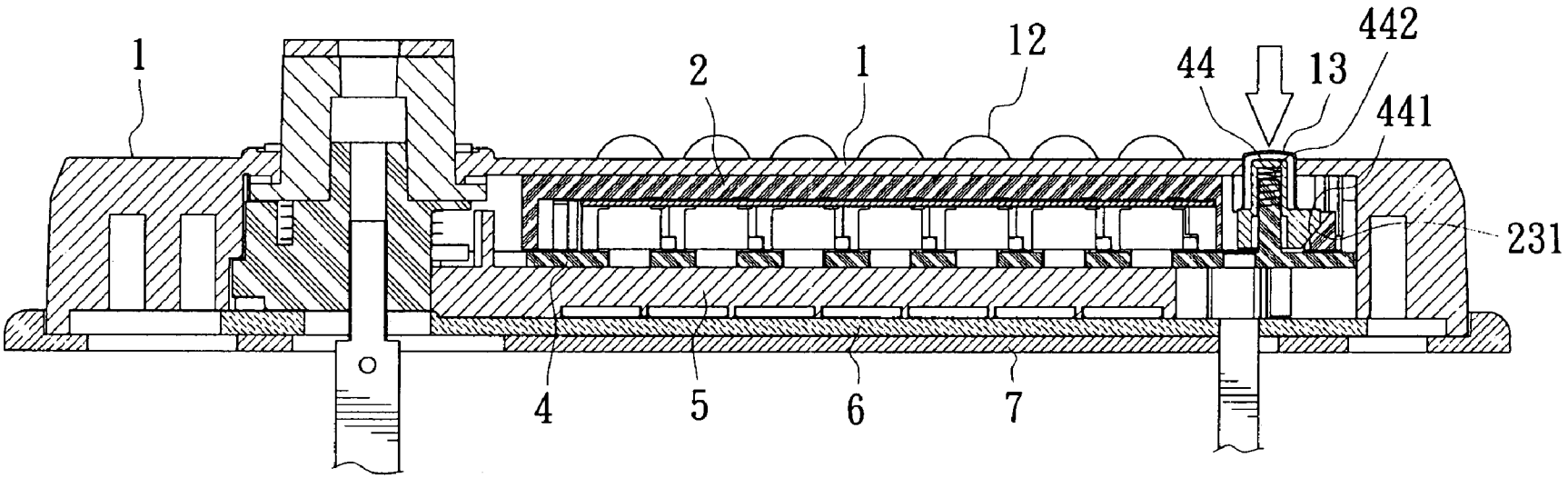
FIG. 19 is a cross sectional view along the Y-Z plane when the reset button is pressed according to the present invention.
Figure 20:
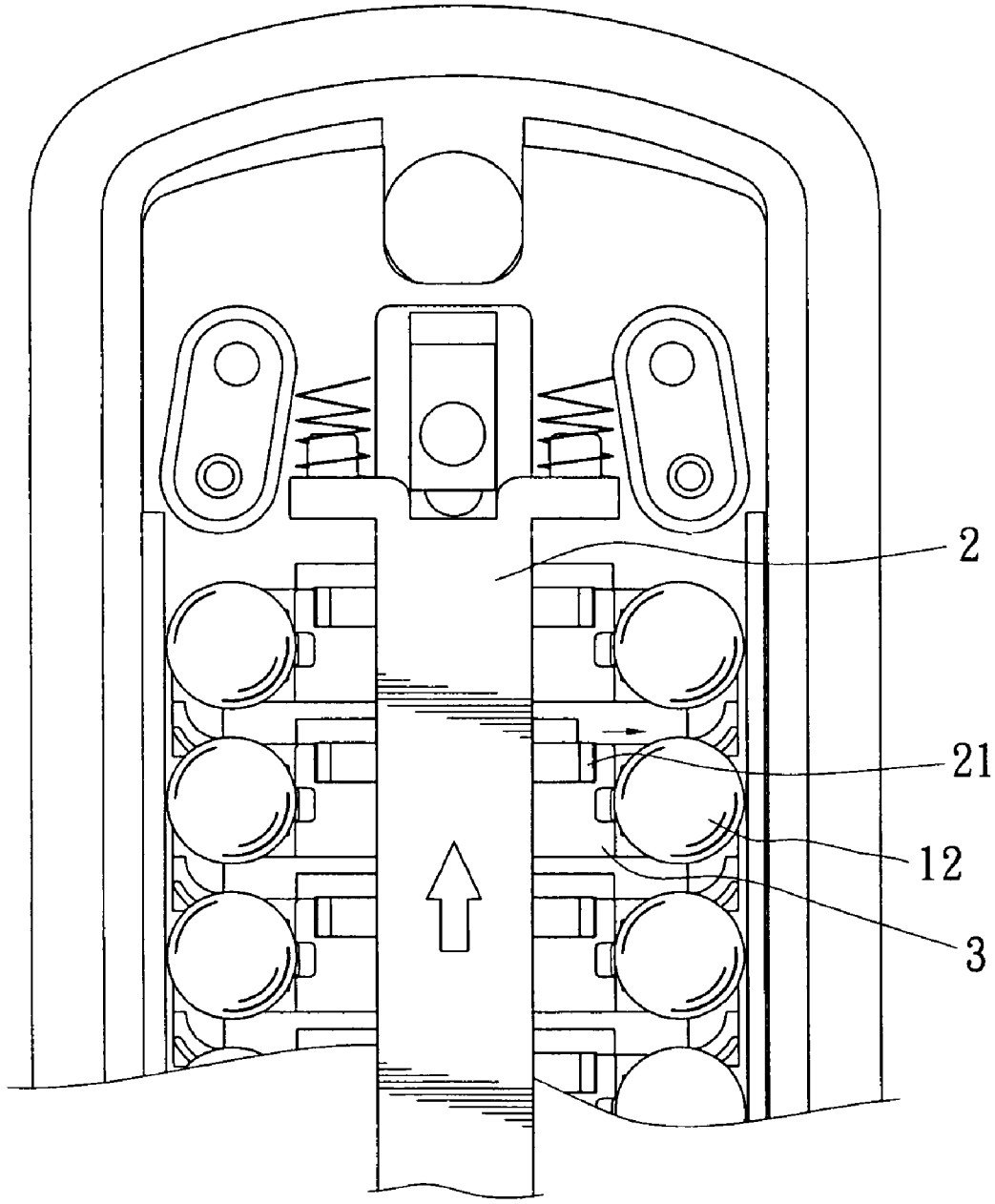
FIG. 20 is a front cross sectional view along the X-Y plane when the reset button is pressed according to the present invention.
Figure 20:
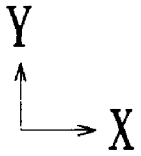

One the code input is wrong, refer to FIG. 1, FIG. 17 and FIG. 18, when the press button 12 is pressed downward, the locking seat 3 is also moved along with the press button 12 and the stopping block 33 of the locking seat 3 originally staggered with respect to the code post 83 of the code member 8 in the non-code area 542 of the moveable seat 5 is changed to correspond to the code post 83 of the code member 8. At this time, the code member 8 is stopped by the stopping block 33 of the locking seat 3 and is unable to move. Thus the knob 14 can't drive the push member 15 as well as the interlock rod 16 for retraction of the latch.

For example, when the code set is "7". When the press button 12 with the specific symbol 17 of "5" is pressed downward by the user and then the locking seat 3 corresponding to the press button 12 with the specific symbol 17 of "5" is moved to make the stopping block 33 of the locking seat 3 that is originally staggered with respect to the code post 83 of the code member 8 change to a corresponding state (corresponding to each other). Now the moveable seat 5 is unable to move due to the code member 8 in the long slot 54 being stopped and locked by the locking seat 3. Thus the knob can't rotate to drive the push member 15 as well as the interlock rod 16 moving for retracting the latch and opening the lock.

Now the pressed press button 12 must be reset so as to release the input wrong code. That means to release the pressed state of the press button 12 with the specific symbol 17 of "5". The releasing way is to press the reset button 13 directly. The elastic part 44 is pressed and contacted by the reset button 13 so that the elastic part 44 pushes the slanting surface 231 of the return base 2 by its slanting surface 441 and the return base 2 moves. Thus the locking of the hook 21 of the return base 2 with the tooth 32 of the locking seat 3 is released and the locking seat 3 turns back to the original position. The code lock is ready to be input a new code again.

In accordance with above embodiment, it is learned that the movement of the press button of the code is horizontal and this is different from the vertical interlocking movement of the prior art. Thus the present invention only requires smooth horizontal movement of the press button of the code while the press button of the code and other components of the prior art require size precision so as to install an interlocking unit. Thus the manufacturing cost and the defect rate are dramatically reduced.

Moreover, while setting the code, there is no need to use any tool. The operation is convenient and easy.

Figure 21:
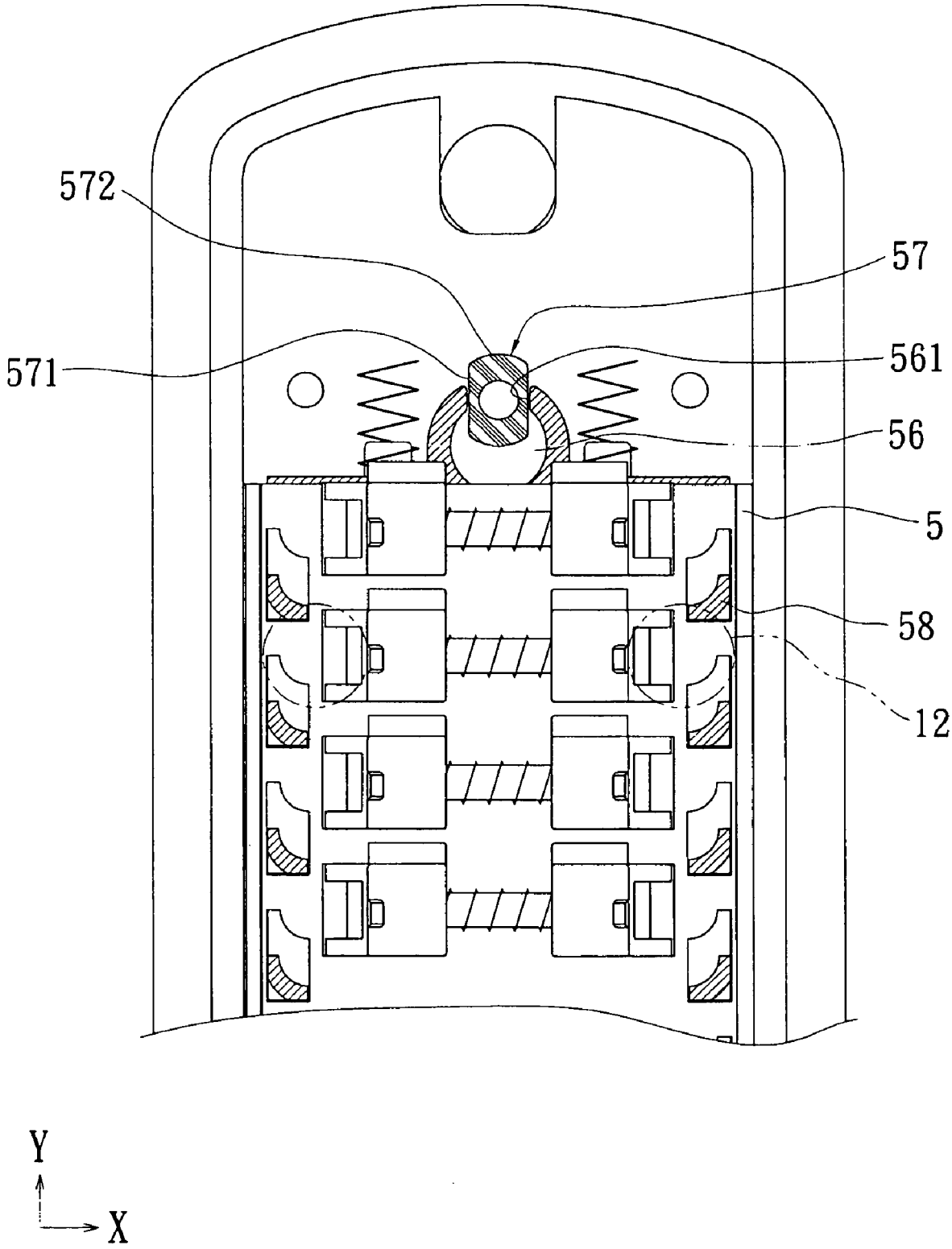
FIG. 21 is a front cross sectional view along the X-Y plane showing relationship between the positioning slot and the rotating positioning rod according to the present invention.
Figure 22:
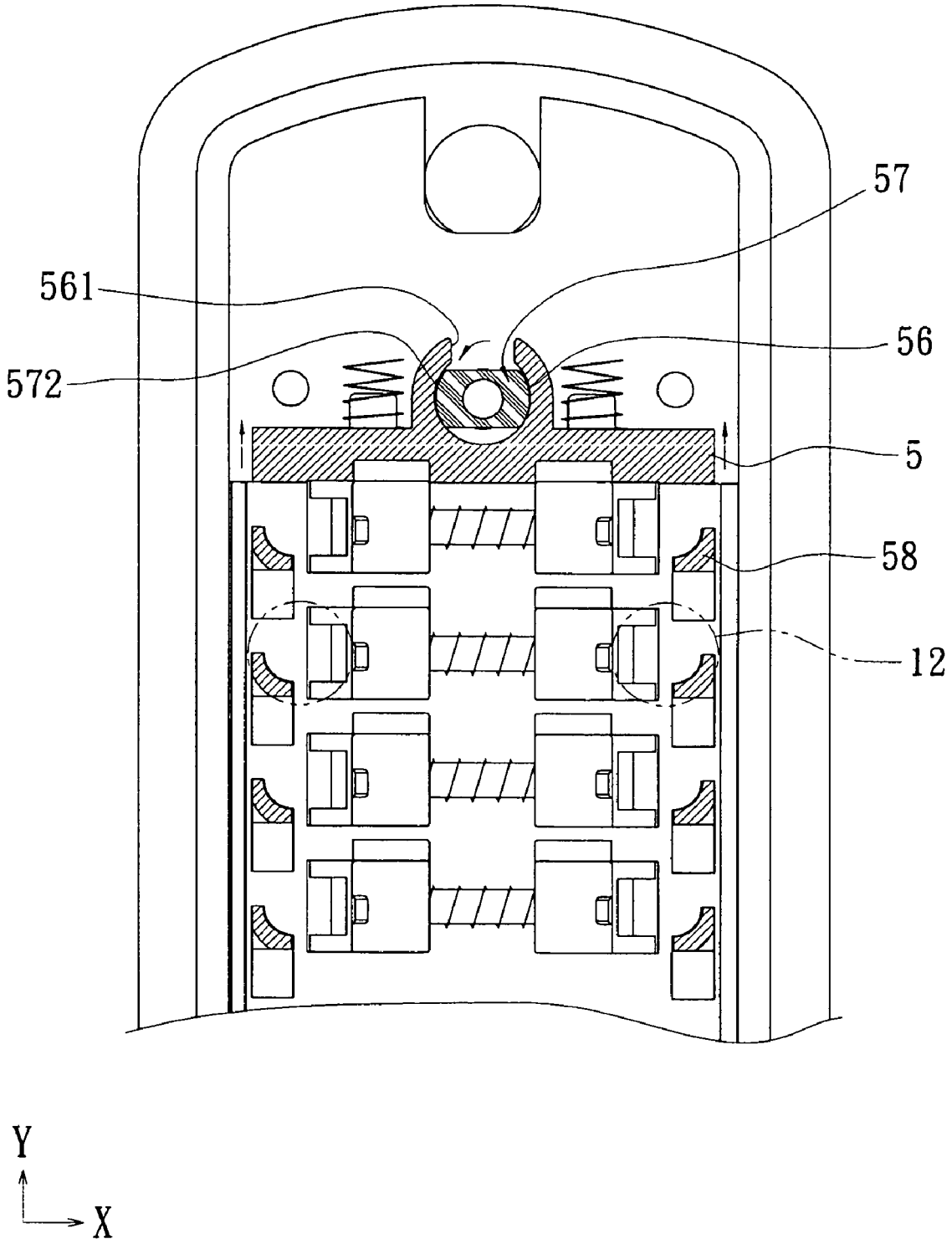
FIG. 22 is a front cross sectional view along the X-Y plane showing the rotating positioning rod being mounted into and rotated into the positioning slot according to the present invention.

Refer to FIG. 1 FIG. 21 and FIG. 22, the code lock of the present invention further includes a positioning slot 56 with an opening 561 arranged at the other end of the moveable seat 5 and a rotating positioning rod 57 disposed on the opening 561 of the positioning slot 56 correspondingly. The rotating positioning rod 57 consists of at least a first outer diameter 571 of the original position and a second outer diameter 572 for rotating and locking. The first outer diameter 571 is corresponding to the width of the opening 561 of the positioning slot 56 while the second outer diameter 572 is corresponding to the width of the positioning slot 56 and the first outer diameter 571 is smaller than the second outer diameter 572. The moveable seat 5 is disposed with a leaning rod 58 beside each long slot 54. Thereby, when correct code is input and the user wants to keep the code lock in an open state, firstly the knob 14 is rotated so as to drive the moveable seat 5 move away from the knob 14 and then the rotating positioning rod 57 is mounted in the positioning slot 56. Next the rotating positioning rod 57 is rotated so as to make the rotating positioning rod 57 lock in the positioning slot 56. Thus the moveable seat 5 is fixed on the position after movement, not forced by the elastic restoring force of the fifth elastic member 53 to go back to the original position. At this moment, each leaning rod 58 is just located under each press button 12 correspondingly to lean against and support each press button 12. Thus each press button 12 is unable to be pressed for input code and the code lock remains in an open state. Therefore, the use is getting in and out directly without input any code. Once the user intends to turn the code lock into a state ready to input code, the rotating positioning rod 57 is rotated directly so as to make the diameter of the rotating positioning rod 57 correspond to the opening 561 of the positioning slot 56 for releasing the positioned state of the moveable seat 5. Thus the moveable seat 5 turns back to the original position due to the elastic restoring force of the fifth elastic member 53.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A code lock comprising: a housing, a return base, a plurality of locking seats, a fixed seat, a moveable seat, a plurality of code members, and a code seat arranged in order from top to bottom, wherein the housing includes a plurality of assembly holes for mounting a plurality of press buttons, a reset button and a knob, the return base disposed under the housing having a plurality of hooks, a leaning part set on one end, a receiving slot with a slanting surface arranged at the other, and at least one first elastic member arranged between the other end of the return base and the housing, the locking seat is arranged over the fixed seat and having an oblique surface, a tooth set both on a top surface thereof, a stopping block disposed on one end thereof away from the tooth, and a second elastic member disposed on one side, thereof while the tooth of the locking seat is corresponding to the hook of the return base;

the fixed seat includes a plurality of parallel long through holes, a plurality of third elastic members and a fourth elastic member respectively leaning against each of the press buttons and the reset button, and an elastic part that supports the reset button and having a slanting surface corresponding to the slanting surface of the return base, the moveable seat includes a pressing part that attaches and contacts with the leaning part of the return base disposed on one end thereof and this end also contacts and moves along with the knob of the housing; the moveable seat further includes a fifth elastic member set between the other end of the moveable seat and the fixed seat while the moveable seat is disposed with a plurality of long slot having a code area and a non-code area, respectively corresponding to the long through hole of the fixed seat and the locking seat, the code seat is arranged under the moveable seat and having a plurality of C-shaped holes corresponding to the long through holes of the fixed seat and the locking seats while the C-shaped hole includes two vertical projecting parts that are connected with each other at one end, and the code member includes a plate and a code post that is projectingly disposed on one side of the plate facing the moveable seat and is inserting through the long slot of the moveable seat.

2. The device as claimed in claim 1, wherein a projecting rod sleeved with the third elastic member is arranged projectingly upward beside the long through hole of the fixed seat.

3. The device as claimed in claim 1, wherein a positioning rod arranged at the other end of the return base is sleeved with one end of the first elastic member while the other end of the first elastic member leans against an inner surface of the housing.

4. The device as claimed in claim 1, wherein a positioning part is disposed projectingly on the moveable seat and is sleeved with one end of the fifth elastic member while the other end of the fifth elastic member is leaning against the fixed seat.

5. The device as claimed in claim 1, wherein the press button is a round bead.

6. The device as claimed in claim 1, wherein the locking seats are arranged in a pair with the second elastic member set therebetween.

7. The device as claimed in claim 6, wherein end surfaces of the pair of locking seat that face the each other respectively are disposed with a rod and a sleeve projectingly while the rod inserts into the sleeve so as to fix and set the second elastic member.

8. The device as claimed in claim 1, wherein a specific symbol is labeled beside each assembly hole of the housing.

9. The device as claimed in claim 1, wherein the code lock includes a housing base connected with and covered by the housing and the housing having a plurality of grooves corresponding to each C-shaped hole of the code seat.

10. The device as claimed in claim 9, wherein a push rod is disposed on one side of the plate of the code member that faces the housing base.

11. The device as claimed in claim 1, wherein a push rod is disposed on one side of the plate of the code member that is opposite to the side facing the code seat.

12. The device as claimed in claim 1, wherein a positioning slot with an opening is arranged at the other end of the moveable seat and a rotating positioning rod is disposed on the opening of the positioning slot correspondingly; the rotating positioning rod includes at least a first outer diameter of the original position and a second outer diameter for rotating and locking; the first outer diameter is corresponding to the width of the opening of the positioning slot while the second outer diameter is corresponding to the width of the positioning slot and the first outer diameter is smaller than the second outer diameter; the moveable seat is further disposed with a leaning rod beside each long slot correspondingly.

13. The device as claimed in claim 1, wherein the fourth elastic member is arranged between the elastic part and the fixed seat so as to make the elastic part have elasticity.

* * * * *